US011591684B2

(12) United States Patent
Tajiri et al.

(10) Patent No.: US 11,591,684 B2
(45) Date of Patent: Feb. 28, 2023

(54) NICKEL-COBALT MATERIAL AND METHOD OF FORMING

(71) Applicant: Unison Industries, LLC, Jacksonville, FL (US)

(72) Inventors: Gordon Tajiri, Waynesville, OH (US); Emily Marie Phelps, Bellbrook, OH (US); Bruce Patrick Graham, Springboro, OH (US); Joseph Richard Schmitt, Springfield, OH (US); Dattu G V Jonnalagadda, Ponnur (IN); Lakshmi Krishnan, Clifton Park, NY (US)

(73) Assignee: Unison Industries, LLC, Jacksonville, FL (US)

( * ) Notice: Subject to any disclaimer, the term of this patent is extended or adjusted under 35 U.S.C. 154(b) by 0 days.

(21) Appl. No.: 17/345,083

(22) Filed: Jun. 11, 2021

(65) Prior Publication Data

US 2022/0049336 A1 Feb. 17, 2022

Related U.S. Application Data

(62) Division of application No. 16/219,249, filed on Dec. 13, 2018, now Pat. No. 11,053,577.

(51) Int. Cl.
*C22F 1/10* (2006.01)
*C22C 19/03* (2006.01)

(52) U.S. Cl.
CPC ..... *C22F 1/10* (2013.01); *C22C 19/03* (2013.01); *C22C 2200/04* (2013.01)

(58) Field of Classification Search
CPC ..... C22F 1/10; C22C 19/03; C22C 2200/04; C22C 19/07
See application file for complete search history.

(56) References Cited

U.S. PATENT DOCUMENTS

| | | | |
|---|---|---|---|
| 4,877,461 | A | 10/1989 | Smith et al. |
| 8,163,111 | B2 | 4/2012 | Roger |
| 8,313,593 | B2 | 11/2012 | Hawk et al. |
| 8,388,890 | B2 | 3/2013 | Hilty et al. |
| 8,545,994 | B2 | 10/2013 | Facchini et al. |
| 8,663,819 | B2 | 3/2014 | Gonzalez et al. |

(Continued)

FOREIGN PATENT DOCUMENTS

| | | | |
|---|---|---|---|
| CN | 102392276 | A | 3/2012 |
| CN | 107604397 | A | 1/2018 |

(Continued)

OTHER PUBLICATIONS

Narayanan, TSN Sankara, A. Stephen, and S. Guruskanthan, "Electroless Ni—Co—B ternary alloy deposits: preparation and characteristics," Surface and Coatings Technology 179.1 (2004): 56-62.

(Continued)

*Primary Examiner* — Jessee R Roe
(74) *Attorney, Agent, or Firm* — McGarry Bair PC

(57) ABSTRACT

A nickel-cobalt material and component includes a thermally stabilized nickel-cobalt alloy. The nickel-cobalt alloy disclosed herein includes nanocrystalline grain structures, pinning, such as Zener pinning, and intragranular twinning. The nickel-cobalt alloy disclosed herein exhibits multiple properties including an improved fracture toughness, an increased thermal stability, and an improved ultimate tensile strength.

10 Claims, 9 Drawing Sheets

(56) References Cited

U.S. PATENT DOCUMENTS

| | | | |
|---|---|---|---|
| 9,427,835 | B2 | 8/2016 | Cheung et al. |
| 10,594,066 | B2 | 3/2020 | Shibuya et al. |
| 2006/0191610 | A1 | 8/2006 | Roger |
| 2010/0075168 | A1 | 3/2010 | Schaffer |
| 2010/0304179 | A1 | 12/2010 | Facchini et al. |
| 2011/0014488 | A1 | 1/2011 | Palumbo et al. |
| 2012/0067464 | A1 | 3/2012 | Chiba et al. |
| 2012/0077069 | A1 | 3/2012 | Maezawa et al. |
| 2014/0329418 | A1 | 11/2014 | Ishikawa et al. |
| 2017/0252807 | A1 | 9/2017 | Lund et al. |
| 2017/0275716 | A1 | 9/2017 | Hill et al. |
| 2020/0055725 | A1 | 2/2020 | Sim et al. |

FOREIGN PATENT DOCUMENTS

| | | | |
|---|---|---|---|
| CN | 110344091 | A | 10/2019 |
| EP | 3708687 | A1 | 9/2020 |
| JP | S54145335 | A | 11/1979 |
| JP | S60162786 | A | 8/1985 |
| JP | S60174891 | A | 9/1985 |
| JP | H03244876 | A | 10/1991 |
| JP | 2001003192 | A | 1/2001 |

OTHER PUBLICATIONS

Hibbard, G.D., K.T. Aust, and U. Erb., "Thermal stability of electrodeposited nanocrystaline Ni—CO Alloys," Materials Science and Engineering: A 433. 1-2 (2006): 195-202.

NICKEL-COBALT MATERIAL AND METHOD OF FORMING

CROSS-REFERENCE TO RELATED APPLICATION(S)

This application is a divisional of U.S. application Ser. No. 16/219,249, filed Dec. 13, 2018, now U.S. Pat. No. 11,053,577, issued Jul. 6, 2021, which is incorporated herein by reference in its entirety.

BACKGROUND

It is of interest to determine materials that can be used in settings with high cycle fatigue and low cycle fatigue. For example, components for engine or turbine engine environments, or other aviation or aerospace environments, may have such material needs.

BRIEF DESCRIPTION

In one aspect, the disclosure relates to a component. The component includes a body wherein at least a portion thereof includes a thermally stabilized nickel-cobalt alloy with nanocrystalline grain structures, pinning and intragranular twinning that exhibits fracture toughness of about 10 $MPa \cdot m^{1/2}$ to 70 $MPa \cdot m^{1/2}$, an increased thermal stability with an onset temperature of about 50% or 60% of the melting temperature for the alloy, and an ultimate tensile strength of from about 1,000 MPa to about 1,500 MPa.

In yet another aspect, the disclosure relates to a nickel-cobalt material. The nickel-cobalt material includes a nanocrystalline grain structure with a grain size distribution of about 50 nanometers to about 110 nanometers, the nanocrystalline grain structure comprising phosphorous precipitates at nanocrystalline grain boundaries and intragranular twinning, the material having a chemical makeup comprising from about 25% to about 40% by atomic weight cobalt, from about 1,000 ppm to about 3,500 ppm by atomic weight of phosphorous or boron, and nickel.

DETAILED DESCRIPTION

Figure 1:
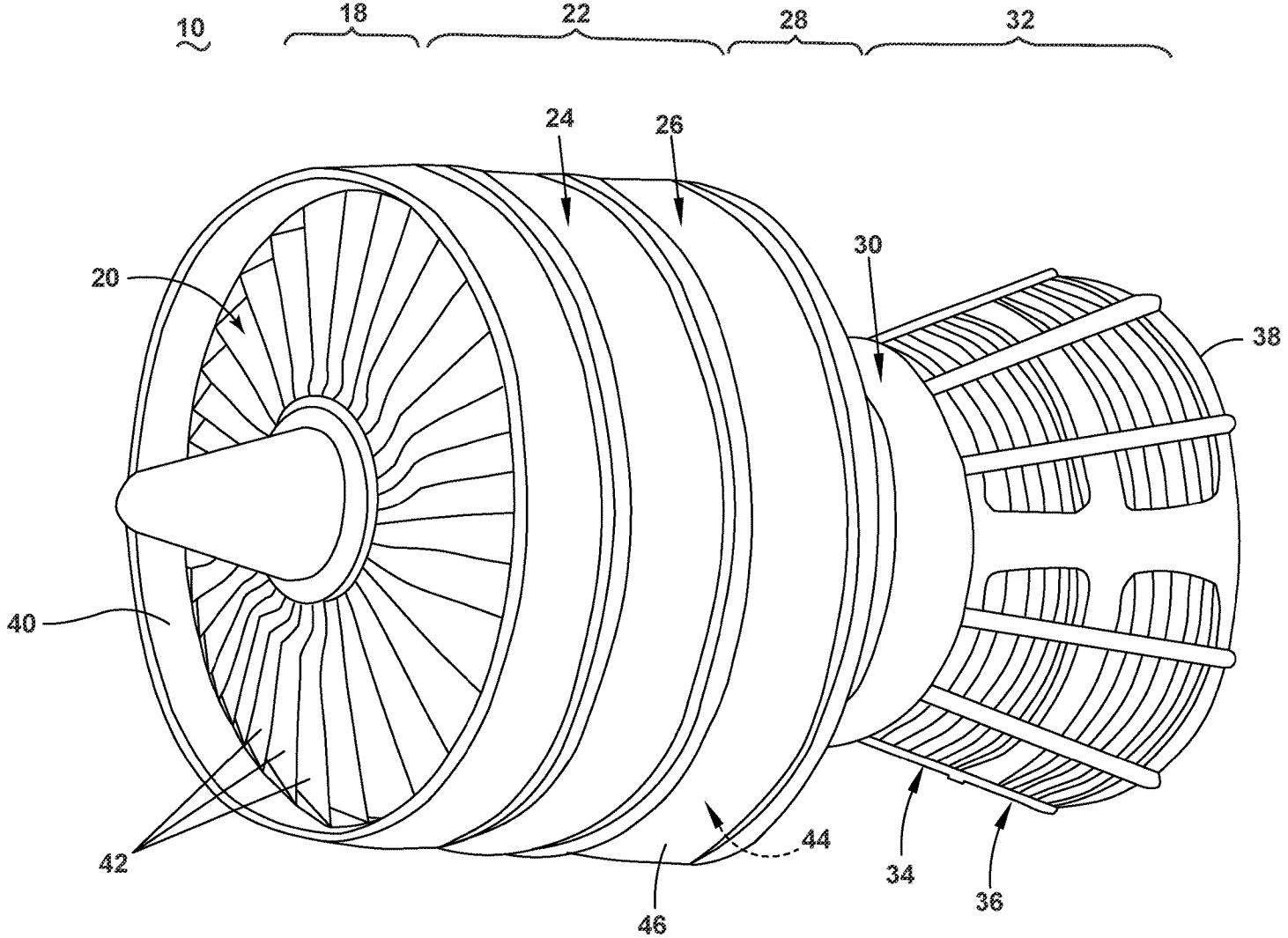
FIG. 1 is a schematic perspective view of a gas turbine engine with an exemplary component including a nickel-cobalt material according to various aspects described herein.

Aircraft turbine engines and specifically fluid delivery systems therein include a harsh environment that faces both low cycle fatigue (LCF) and high cycle fatigue (HCF) environments. Current aircraft turbine engine designs with standard coarse-grain annealed sheet metal and tubing with standard gauge wall thicknesses are over designed for a highly localized worst-case stress conditions. Regions with low stresses have the same uniform wall thickness and are typically over designed. In general, while an additive electroforming process is customizable, adding material only where it is needed, a high-performance electrodeposited material with high fatigue-resistance, high-temperature stability, strength, and toughness does not currently exist.

Aspects of the present disclosure relate to reducing fatigue crack initiation, propagation, and failure for nickel-cobalt materials. Aspects of the present disclosure relate to nanocrystalline nickel-based novel electrodeposited alloy(s) with excellent thermal stability, high-strength low cycle fatigue, and crack-resistant high cycle fatigue material performance. This results in efficient use of material via the electrodeposition process for a wide range of uses, including use as turbine engine components.

The relationship between strength and grain size is associated with interactions between dislocations and grain boundaries. Under an applied stress, dislocations existing within a crystalline lattice or initiated by plastic deformation can propagate along slip planes across the crystalline lattice and along grain boundaries. The dislocations tend to accumulate at grain boundaries, as the grain boundaries provide a repulsive stress in opposition to continued propagation of the dislocations. When the repulsive stress of a grain boundary exceeds the propagation force of the dislocations, the dislocations are unable to move past the grain boundary. As the dislocations accumulate, their collective propagation force increases. In this manner, the dislocations can move across the grain boundary when their propagation force exceeds the repulsive stress of the grain boundary.

Decreasing a grain size also decreases the space available for possible accumulation of dislocations at the grain boundary, thereby increasing the amount of applied stress necessary for a dislocation to propagate across the grain boundary. The higher the applied stress needed to move the dislocation, the higher the yield strength. Accordingly, there is an inverse relationship between grain size and strength, which can be described by the Hall-Petch relationship as follows in (1) below:

$$\sigma \propto \frac{1}{\sqrt{a}} \tag{1}$$

where $\sigma$ is strength and a is the grain size. Thus, the strength of a material generally increases with decreasing grain size according to the Hall-Petch relationship. As this relationship is asymptotic, the material strength generally increases as grain size decreases to a certain minimum value, below which point the Hall-Petch relationship no longer holds. Accordingly, there is a limit to the increase in strength attainable by reducing grain size alone.

The presently disclosed nickel-cobalt materials and components made therefrom can provide for improved fatigue resistance, strength, and thermal stability. The enhanced fatigue resistance may be attributable at least in part to a phosphorous dopant, a level of cobalt in the nickel-cobalt alloy, or a heat treatment performed upon the precursor material. Generally, each of these aspects may at least partially contribute to the fatigue resistance, tensile strength, and thermal stability of the presently disclosed phosphorous-doped nickel-cobalt alloys and components. In addition, aspects of the disclosure that include phosphorous, such as for stabilization or pinning, can be replaced with other similar alloying elements, including boron or manganese in non-limiting examples. In addition, the presently disclosed materials can also include other alloys such as nickel-phosphorous, nickel-cobalt-manganese, nickel-boron, or cobalt-phosphorous, in non-limiting examples.

For purposes of illustration, aspects of the disclosure will be described in the context of a gas turbine engine component. Gas turbine engines have been used for land and nautical locomotion and power generation, and are also commonly used for aeronautical applications such as airplanes or helicopters. It will be understood, however, that the disclosure is not so limited and can have general applicability in non-aircraft applications, such as other mobile applications and non-mobile industrial, commercial, and residential applications.

As used herein, "a set" can include any number of the respectively described elements, including only one element. In addition, as used herein, being "flush" with a given surface will refer to being level with, or tangential to, that surface. Additionally, all directional references (e.g., radial, axial, proximal, distal, upper, lower, upward, downward, left, right, lateral, front, back, top, bottom, above, below, vertical, horizontal, clockwise, counterclockwise, upstream, downstream, aft, etc.) are only used for identification purposes to aid the reader's understanding of the present disclosure, and do not create limitations, particularly as to the position, orientation, or use of the present disclosure. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order, and relative sizes reflected in the drawings attached hereto can vary.

An exemplary turbine engine 10 is illustrated in FIG. 1. The turbine engine 10 can be a gas turbine engine, including a turbofan, turboprop, or turboshaft engine in non-limiting examples. The turbine engine 10 includes, in downstream serial flow relationship, a fan section 18 including a fan 20, a compressor section 22 including a booster or low pressure (LP) compressor 24 and a high pressure (HP) compressor 26, a combustion section 28 including a combustor 30, a turbine section 32 including a HP turbine 34, and a LP turbine 36, and an exhaust section 38.

The fan section 18 includes a fan casing 40 surrounding the fan 20. The fan 20 includes a plurality of radially-disposed fan blades 42. The HP compressor 26, the combustor 30, and the HP turbine 34 form a core 44 of the engine 10, which generates combustion gases. The core 44 is surrounded by core casing 46, which can be coupled with the fan casing 40. The compressor section 22 provides the combustor 30 with high pressure air. The high pressure air is mixed with fuel and combusted in the combustor 30. The hot and pressurized combustion gases pass through the HP turbine 34 and LP turbine 36 before exhausting from the turbine engine 10.

As the pressurized gases pass through the compressor section 22, the turbines 34, 36 extract rotational energy from the flow of the gases passing through the turbine engine 10. The HP turbine 34 can be coupled to a compression mechanism (not shown) of the compressor section 22 by way of a shaft to power the compression mechanism. The LP turbine 36 can be coupled to the fan 20 by way of a shaft to power the fan 20. Optionally, the turbine engine 10 can also have an afterburner that burns an additional amount of fuel downstream of the turbine section 32 to increase the velocity of the exhausted gases, thereby increasing thrust.

Components of the turbine engine 10 can be subjected to high temperatures and stresses, including low cycle fatigue and high cycle fatigue, as well as other disturbances that may occur during operation. Non-limiting examples of such components include rotating or stationary airfoils within the compressor section 22 or turbine section 32, or components included in or coupled to the core casing 46 including hangers, shrouds, or seals. Such components can include materials designed for strength, resilience, or temperature requirements of the surrounding environment, including metal alloys.

Figure 2:
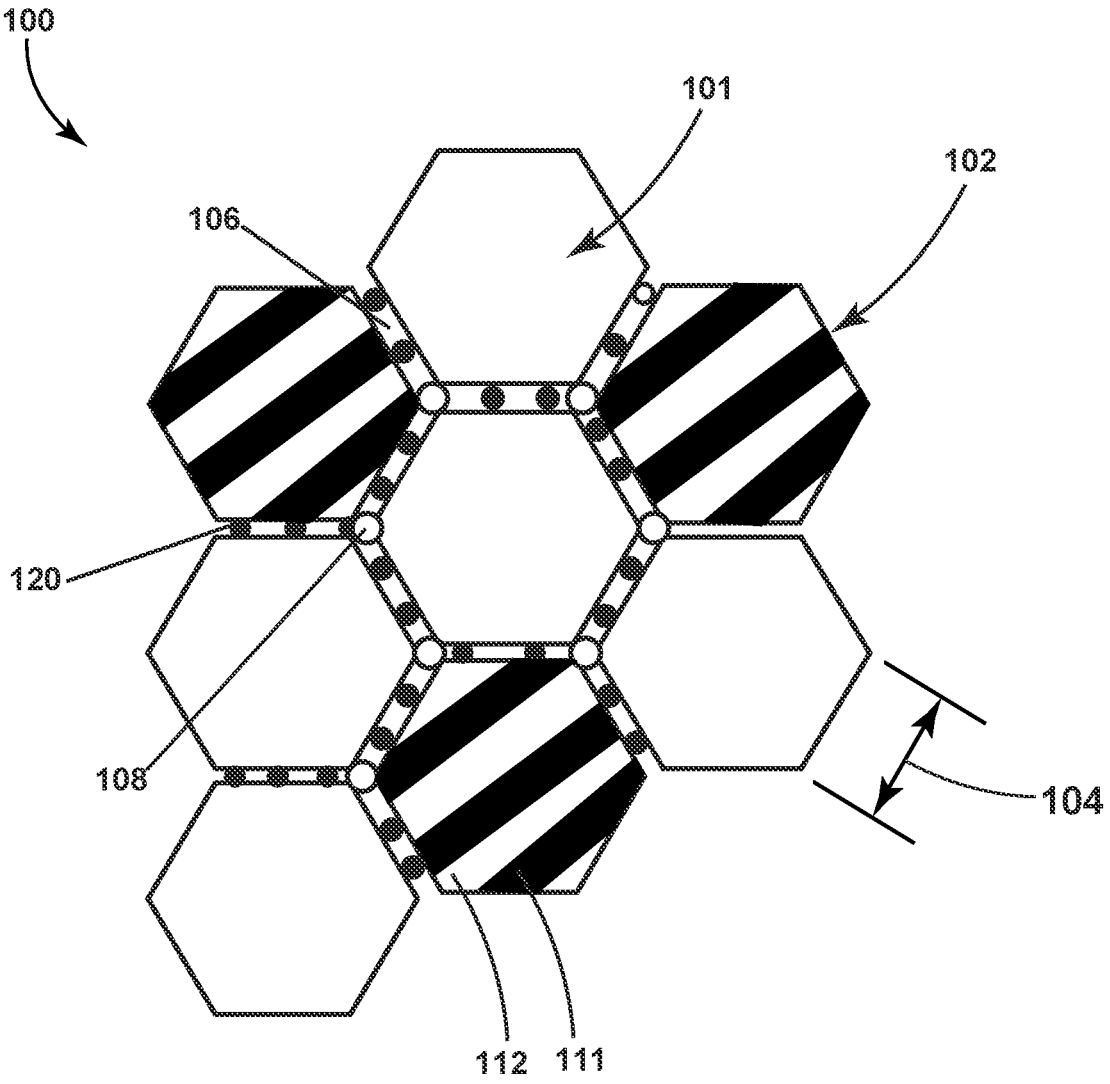
FIG. 2 is a schematic illustration of an exemplary nickel-cobalt material that can be utilized in the component of FIG. 1.

It has been determined that electrodeposited nanocrystalline nickel-cobalt-phosphorous material has unique microstructural characteristics that increase fatigue resistance. These features significantly enhance resistance to crack initiation and increases fracture toughness. FIG. 2 illustrates an exemplary heat-treated nickel-cobalt material or alloy, which is herein referred to as nickel-cobalt material 100 that can be utilized in a component or portion thereof in the turbine engine 10 (FIG. 1). The exemplary nickel-cobalt material 100 is illustrated with un-twinned nanocrystalline nickel-cobalt grains, which is herein referred to as un-twinned grains 101, as well as twinned nanocrystalline nickel-cobalt grains, which is herein referred to as twinned grains 102. The un-twinned grains 101 or twinned grains 102 can be distributed homogeneously or heterogeneously throughout the nickel-cobalt material 100. Structures or grains of other sizes beyond those shown in FIG. 2, including amorphous metal structures or twinned or non-twinned grains of any suitable size such as microcrystalline grains or coarse grains, can also be utilized in the nickel-cobalt material 100; however, it has been determined that the nanocrystalline sized grains provide additional benefits for fatigue resistance.

The grains 101, 102 can have an average grain size 104 that is in a nanocrystalline region. For example, "nanocrystalline region" can refer to a region having grain sizes on a nanometer scale, such as less than 100 nm in one non-limiting example.

Grain boundaries 106 are defined along adjacent grains 101, 102, and triple-junction micro-voids 108 are defined at the junction of three adjacent grains 101, 102 as shown. The twinned grains 102 are illustrated with a first twin 111, illustrated darker for clarity, and a second twin 112.

Precipitates, illustrated as phosphorous precipitates 120, can also be included within the nickel-cobalt material 100. The phosphorous precipitates 120 are illustrated at the grain boundaries 106. While not shown for clarity, phosphorous precipitates can also be dispersed within the grains 101, 102 (e.g. within the grain lattice) as well as at the grain boundaries 106. The phosphorous precipitates 120 can provide Zener pinning that inhibits further grain growth via a pinning force that resists movement of dislocations or other grain boundaries from propagating therethrough. The phosphorous precipitates 120 or the intragranular twins in any or all of the grains 101, 102 can provide added strength or fatigue resistance. It is also contemplated that precipitates of other alloying materials, including boron or manganese, can be utilized in place of or in addition to the phosphorous precipitates 120.

The exemplary nickel-cobalt material 100 can include from about 30% to about 35% by atomic weight of cobalt, from about 1,000 ppm to about 3,500 ppm by atomic weight of phosphorous, and nickel as the balance of the material. It is also contemplated that other ranges or proportions of nickel, cobalt, or phosphorous can be utilized. In other non-limiting examples, the concentration of nickel in the nickel-cobalt material 100 can be from about 60% to about 80% by atomic weight. The concentration of cobalt in the nickel-cobalt material 100 can be from about 20% to about 50%. The concentration of the phosphorous in the nickel-cobalt material 100 can be from about 500 ppm to about 2,000 ppm by atomic weight.

Figure 3:
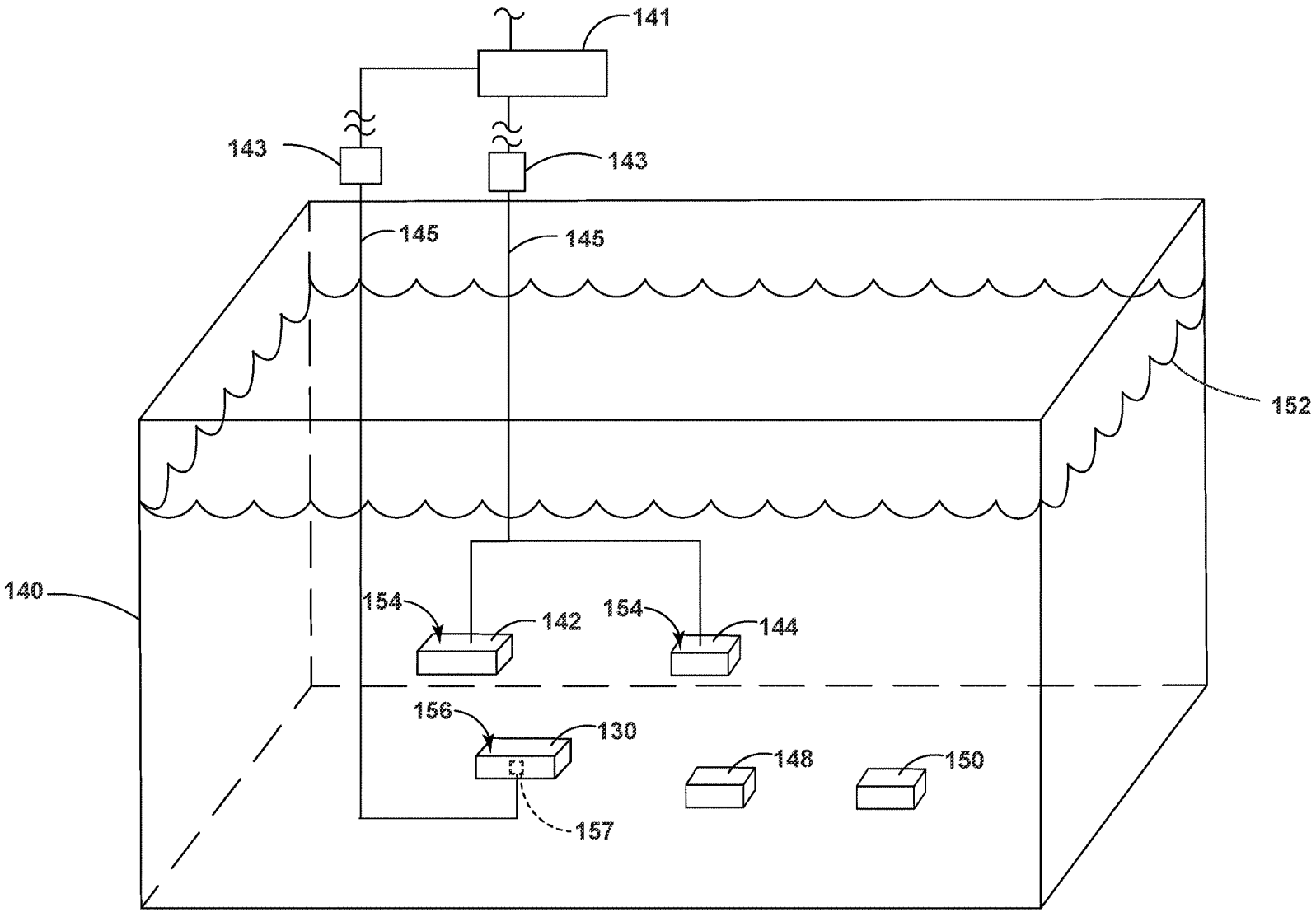
FIG. 3 is a schematic illustration of an electroforming bath for forming a precursor material to the nickel-cobalt material of FIG. 2.

FIG. 3 illustrates that the exemplary nickel-cobalt material 100 can be formed by producing a doped nickel-cobalt precursor material, which is herein referred to as precursor material 130 using an electrodeposition process. The precursor material 130 can be formed using any suitable electrodeposition process, such as a Watts bath. The electrodeposition process can be carried out using an electrodeposition bath 140 that contains a nickel source 142, and a cobalt source 144. Optionally, a phosphorous source (not shown) can be included either within the electrodeposition bath 140 or added separately as a liquid solution. The electrodeposition bath 140 can additionally include boric acid or a salt thereof to prevent electrode surface passivation or nickel reduction and to act as a surface agent, one or more chelating agents or complexing agents for chelating or complexing particular ions in the electrodeposition bath, or saccharin inhibitor to control grain size. Additionally, the electrodeposition bath can include one or more surfactants to reduce the tendency for pitting. The electrodeposition bath can further include various other additives at concentrations of less than 1% by weight, including, buffering agents, wetting agents, grain refiners, brighteners, and so forth.

The nickel source 142 for the electrodeposition bath 140 can include nickel sulfate, nickel hypophosphite, nickel oxide, nickel carbonate, or nickel chloride, as well as combinations of these. Preferably, the nickel source 142 includes nickel sulfate. The nickel source 142 can be provided at an ion concentration of from about 50 to mM to about 1 M, such as from about 250 mM to about 750 mM.

The cobalt source 144 for the electrodeposition bath 140 can include cobalt sulfate, cobalt chloride, or a cobalt carbonate, as well as combinations of these. Preferably, the cobalt source 144 includes cobalt sulfate. The cobalt source can be provided at an ion concentration of from about 10 to mM to about 100 mM, such as from about 25 mM to about 75 mM.

The phosphorous source 146 for the electrodeposition bath 140 can include hypophosphorous acid or a hypophosphite salt. Exemplary hypophosphite salts include sodium hypophosphite, potassium hypophosphite, nickel hypophosphite, or ammonium hypophosphite, or other hypophosphite salts of alkali or alkaline earth metals, as well as combinations of these. Preferably, the phosphorous source 146 includes sodium hypophosphite. The phosphorous source 146 can be provided at an ion concentration of from about 50 to mM to about 500 mM, such as from about 100 mM to about 250 mM.

One or more chelating agents 148 or complexing agents 150 can be included in the electrodeposition bath. Exemplary chelating agents 148 include malonic acid, oxalic acid, succinic acid, citric acid, malic acid, maleic acid, tartaric acid, ethylenediamine, ethylenediamine tetraacetic acid (EDTA), triethylene tetraamine, diethylene triamine, hydrazobenzene, amino acids, as well of salts of any of the foregoing. Exemplary complexing agents 150 include acetic acid, propionic acid, glycolic acid, formic acid, lactic acid, glycine, as well as salts of any of the foregoing. Salt forms of chelating agents or complexing agents can include alkali or alkaline earth metal salts, ammonium salts, nickel salts, and cobalt salts. Preferably, the electrodeposition bath 140 includes at least one chelating agent 148 and at least one complexing agent 150. One or more chelating agents 148 can be provided at a concentration of from about 10 mM to about 250 mM, such as from about 25 mM to about 200 mM. One or more complexing agents 150 can be provided at a concentration of from about 100 mM to about 750 mM, such as from about 250 mM to about 500 mM. Exemplary surfactants for the electrodeposition bath include octylphenol ethoxylates (e.g., Triton™ X-100, etc.), octylphenoxypolyethoxyethanol (e.g., IGEPAL™ CA-630, etc.), sodium dodecyl sulfate (SDS) and so forth. One or more surfactants can be provided at a concentration from about 10 to about 1,000 ppm by weight.

A bath solution 152 can be prepared by combining the various components in an aqueous carrier. Typically, the bath solution 152 can be maintained at an acidic pH of about 3.3 to 4.3, such as about 3.5 to 4.0 using a suitable acidic agent (e.g., hypophosphorous acid, ortho-phosphorous acid, or sulfuric acid,) and a suitable basic agent (e.g., sodium hydroxide). The electrodeposition bath 140 includes one or more anodes 154, such as the nickel source 142, cobalt source 144, or phosphorous source 146 that can release ions into the electrodeposition bath. The electrodeposition bath 140 can also include one or more cathodes 156. The one or more cathodes 156 can serve as a mandrel 157 that defines a shape of the precursor material 130 deposited thereon. The mandrel 157 can include an oxide coating that allows the precursor material 130 to be easily separated therefrom.

The electrodeposition process can be conducted at a bath temperature of less than about 60° C., such as from about 40° C. to 55° C. A wide range of current densities can be utilized, including a modulating current density. One exemplary current density can range from about 5 to 500 mA/cm$^2$.

One or more parameters of the electrodeposition bath 140 can be varied to provide a desired precursor crystalline structure including the deposition of nanocrystalline grain regions. For example, in some aspects, pulse plating techniques can be utilized to vary the nucleation rate and growth of existing grains, such as by varying peak current density, pulse-on time and pulse-off time, or by reverse pulsing. Pulse plating can be particularly attractive because it can yield finer grain structures than that achievable by direct current plating. Other electrodeposition parameters to provide the desired precursor crystalline structure, such as providing a variable bath composition, agitation rate, pH, and so forth.

The electrodeposition conditions including bath chemistry and pulsing parameters can be selected so as to provide a resulting precursor material, such as the doped nickel-cobalt precursor material 130, having a desired structure. In some aspects, the precursor material 130 can have a metallic structure including crystalline regions made up of nanocrystalline grain structures. Amorphous regions can optionally be included, and in such a case the proportion of amorphous regions to crystalline regions in the precursor material 130 can be selected so as to achieve a desired thermal stabilization or strengthening following heat treatment.

In one non-limiting example, the electrodeposition process can provide the precursor material 130 substantially in the form of a phosphorous-doped nickel-cobalt material including nanocrystalline grain material. The nanocrystalline grain material can have a grain size distribution of less than approximately 100 nm, such as from about 50 nanometers to about 100 nanometers. As another example, the electrodeposition process can provide the precursor material 130 substantially in the form of a boron-doped nickel-cobalt nanocrystalline grain material, with a grain size distribution from about 50 to 100 nanometers.

Once electrodeposition is complete, the precursor material 130 can be subjected to heat treatment using any desired heat treatment system, including, for example, a batch furnace or a continuous furnace. When subjected to heat treatment as described herein, such a precursor material can exhibit a relatively high fatigue resistance, ductility, or tensile strength.

It is contemplated that a controlled atmosphere can be provided. The controlled atmosphere can supply one or more gasses to the heat treatment system, optionally under a negative pressure environment. As examples, one or more gases can include hydrogen, nitrogen, argon, ammonia, carbon dioxide, carbon monoxide, helium, hydrocarbons (e.g., methane, ethane, propane, butane, etc.), or steam, as well as combinations of these. The one or more gases can provide an endothermic atmosphere or an exothermic atmosphere. The particular heat treatment time and temperature schedule will depend on the composition of the precursor material 130 and the desired resulting properties following heat treatment.

Figure 4:
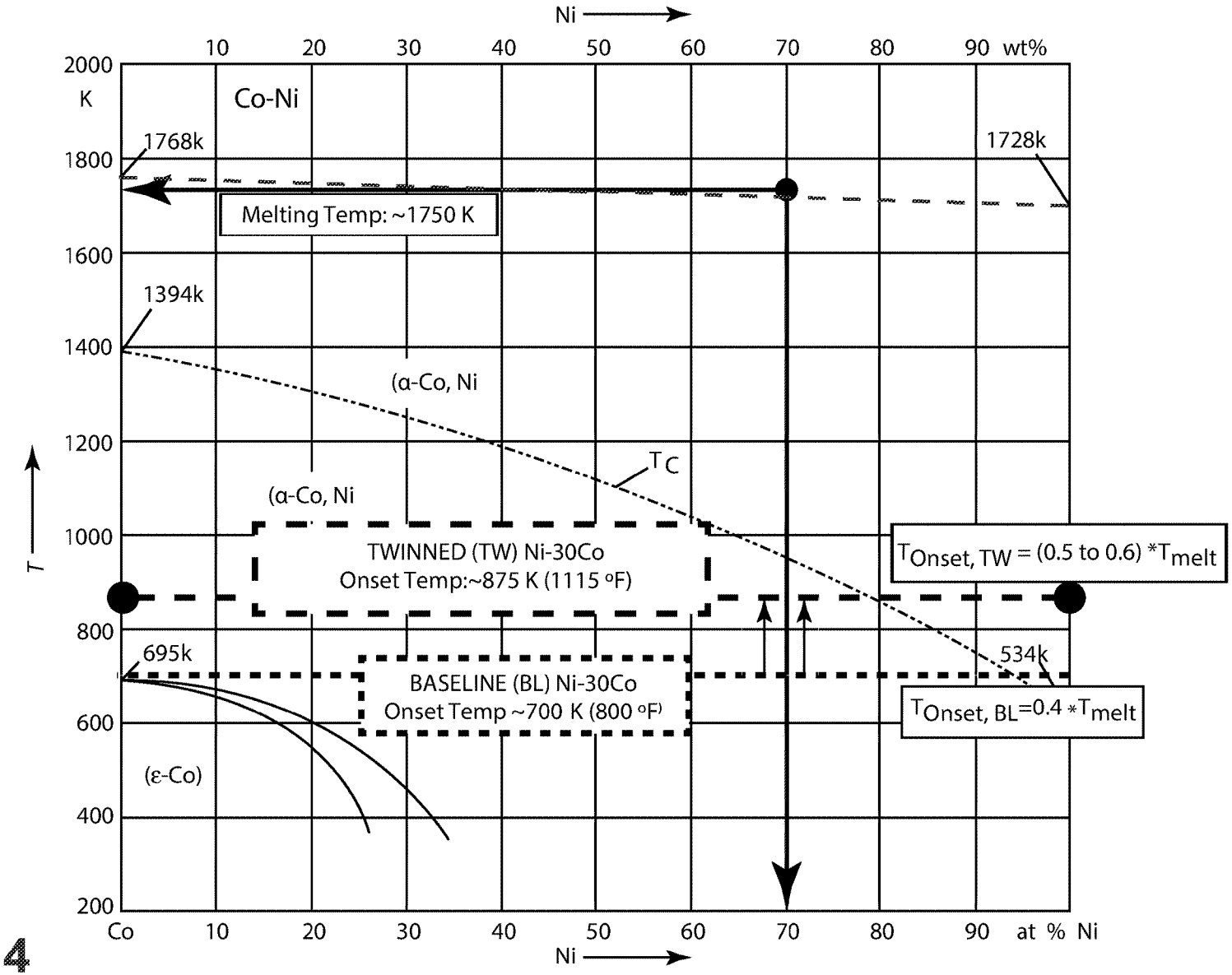
FIG. 4 is a phase diagram for the nickel-cobalt material of FIG. 2 including an exemplary onset temperature for grain growth during formation of the nickel-cobalt material.

It is contemplated that the precursor material 130 can be subjected to a precipitate strengthening heat treatment. FIG. 4 illustrates a phase diagram 160 for the nickel-cobalt material 100 with exemplary heat treatment zones superimposed thereon for the precipitate strengthening heat treatment.

The heat treatment can be performed at a temperature, or within a temperature zone, below the onset temperature for grain growth so as to provide a precipitate strengthening heat treatment. The onset temperature for grain growth in the precursor material can be determined by performing an isochronal heat treatment test for the precursor material. In the illustrated example, a phosphorous-doped nickel-cobalt alloy with 30% cobalt can have a baseline onset temperature $T_{onset}$ of about 700 K. However, it will be appreciated that the onset temperature for grain growth can vary depending on the composition of the precursor material. The precipitate strengthening heat treatment provides phosphorous precipitates 120 which can cause Zener pinning. The precipitate strengthening heat treatment can be performed at a constant temperature. Alternately the temperature can vary, such as according to a heat treatment cycle that includes a sequence of heat treatment temperatures. Optionally, the material resulting from the first precipitate strengthening heat treatment can be quenched or cooled slowly.

In other non-limiting examples, the precipitate strengthening heat treatment can include heat treating within a temperature zone from about 600 K to about 750 K, such as from about 630 K to about 700 K in a non-limiting example. In other non-limiting examples, the precipitate strengthening heat treatment can be performed within a temperature zone according to a heat treatment cycle that includes one or more increases in temperature up to the onset temperature for grain growth for a period of time. For example, with an onset temperature of 700 K, an exemplary precipitate strengthening heat treatment can include heat treating according to a cycle within a temperature zone from about 630 K to about 700 K, with a first portion of the cycle carried out within a temperature zone from about 630 K to about 670 K, and a second portion of the cycle carried out within a temperature zone from about 670 K to about 700 K.

The amount of shear stress sufficient to form intragranular twins during electrodeposition can be described by a critical shear twinning stress, rent as shown in Equation 2 below:

$$\tau_{crit} = \frac{2\gamma_{SF}}{b} \tag{2}$$

where b is a Burgers vector representing the magnitude and direction of the lattice distortion resulting from a dislocation in a crystal lattice. As the critical shear twinning stress will be lower when the stacking fault energy is lower, increasing cobalt concentration in the nickel-cobalt alloy favors intragranular twinning. Deformation twins can also form in the nickel-cobalt material 100 under an applied load such as a resonant vibration.

Intragranular twins (such as the first and second twins 111, 112) formed during heat treatment can be referred to as annealing twins. The probability of forming annealing twins p can be described in relation to grain size D and a material dependent constant B, which is inversely proportional to stacking fault energy, as shown in Equation 3 below:

$$p = \frac{B}{D}\log\left[\frac{D}{D_O}\right] \tag{3}$$

where $D_o$ is the grain size at which p is zero. As B is inversely proportional to stacking fault energy, a low stacking fault energy associated with increasing cobalt concentration in the nickel-cobalt material 100 also favors formation of annealing twins.

Taken individually or in combination, the presence of phosphorous precipitants 120 pinning grain boundaries 106 of the nickel-cobalt material 100, or intragranular twinning attributable to the elevated cobalt level in the nickel-cobalt material 100, can provide for increased thermal stability of the nickel-cobalt material 100. Thermal stability can be characterized with reference to the onset temperature, $T_{onset}$ for grain growth in the nickel-cobalt alloy. Typically, the onset temperature for grain growth in a nickel-cobalt alloy corresponds to about 40% of the melting temperature, $T_{melt}$ for the alloy. However, the introduction of phosphorous precipitants 120 or an elevated level of cobalt can increase the onset temperature through pinning or intragranular twinning, respectively. In some aspects, the onset temperature $T_{onset}$ for grain growth in the nickel-cobalt material 100 can be increased to about 50% or 60% of the melting temperature, $T_{melt}$ for the alloy.

Figure 5:
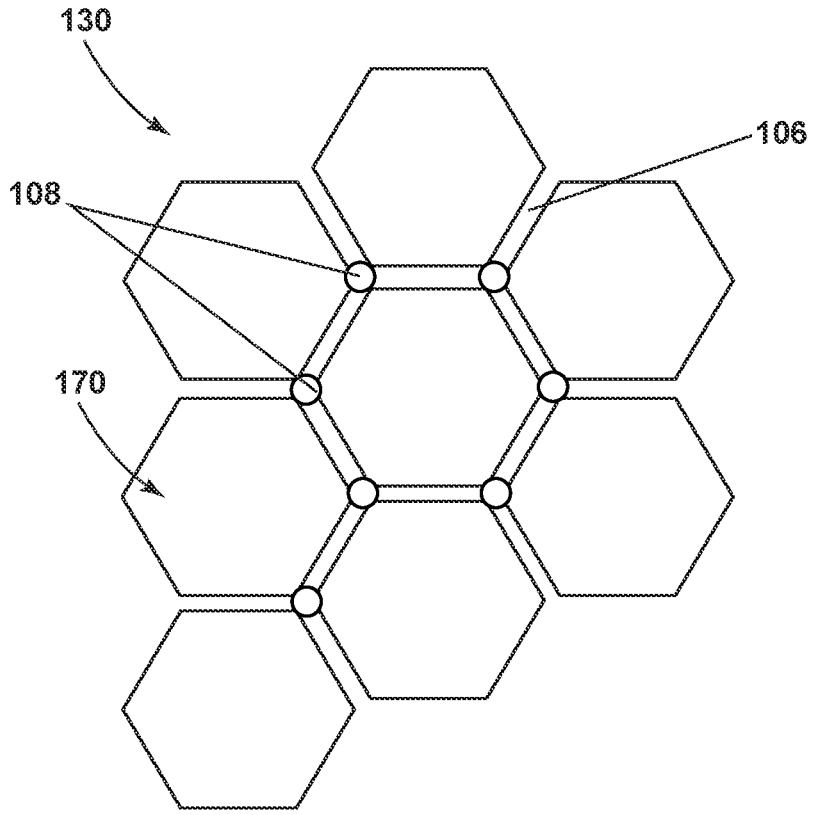
FIG. 5 is a schematic illustration of the precursor material of FIG. 3.

Referring now to FIG. 5, the phosphorous-doped nickel-cobalt precursor material 130 is illustrated with a group of un-twinned, non-heat-treated nanocrystalline nickel-cobalt grains, herein referred to as non-treated grains 170. The non-treated grains 170 of the precursor material 130 are illustrated as un-twinned grains. Some of the non-treated grains 170 may exhibit twinning, and it is also contemplated that some of the non-treated grains 170 can have a single grain orientation after electrodeposition.

Figure 6:
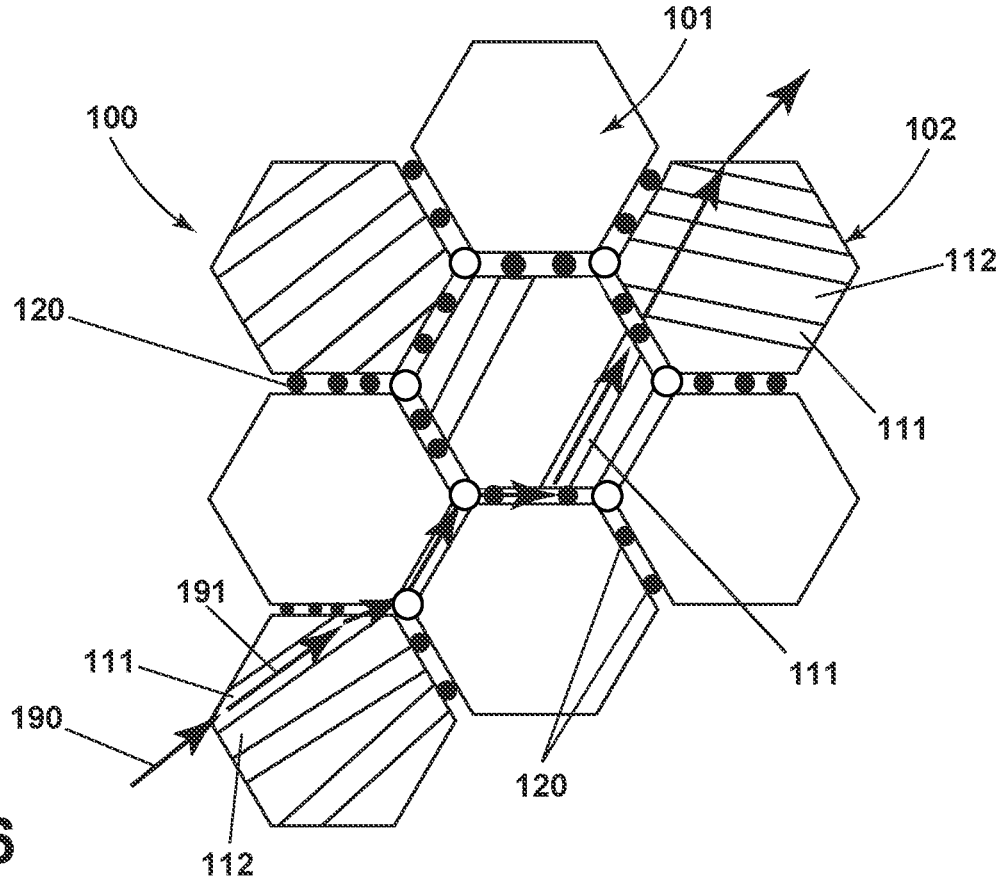
FIG. 6 is a schematic illustration of the precursor material of FIG. 5 after a heat treatment to form the nickel-cobalt material of FIG. 2.

FIG. 6 illustrates the precursor material 130 of FIG. 5 after a heat treatment as described above to form the heat treated nickel-cobalt material 100 having the un-twinned grains 101 and twinned grains 102. As described above, the heat treatment can include at least heating at a temperature, or within a temperature zone, below the onset temperature for grain growth in the doped nickel-cobalt precursor material 130, including heating within a temperature zone from about 650 K to about 700 K, to form the heat treated nickel-cobalt material 100. The heat treatment can form twinned grains 102. The heat treatment can also form phosphorous precipitates 120 along the grain boundaries 160 as shown, or within the grains 101, 102 (not shown for clarity). The phosphorous precipitates 120 can provide for Zener pinning as described above.

Intragranular twinning can also occur under high temperature or high stress operating conditions, further providing thermal stability for components formed of the presently disclosed nickel-cobalt material 100. Intragranular twinning can occur as a result of shear stresses introduced through grain growth, which can arise from stacking faults located at migrating grain boundaries, as well as from grain boundary dissociations, grain encounters, or growth accidents.

An exemplary crack propagation or failure path 190 is shown through the nickel-cobalt material 100, such as under cyclical loading or tensile stress. The failure path 190 is illustrated as including both intergranular and transgranular failure modes. For example, four exemplary portions of the failure path 190 are illustrated. A first portion 191 follows a first twin 111 of a twinned grain 102 in a transgranular failure mode. A second portion 192 follows a grain boundary 106 in an intergranular failure mode. A third portion 193 follows a first twin 111 of another twinned grain 102 in a transgranular failure mode, and a fourth portion 194 crosses first and second twins 111, 112 of still another twinned grain 102 in another transgranular failure mode.

In contrast, a crack propagation path through a typical nickel-cobalt alloy tends to follow an intergranular failure mode along the grain boundaries, which occurs with relatively lower tensile stress as compared to a transgranular failure mode. It can be appreciated that the heat-treated nickel-cobalt material 100 has a higher strength compared to other typical nickel-cobalt alloys.

Figure 7:
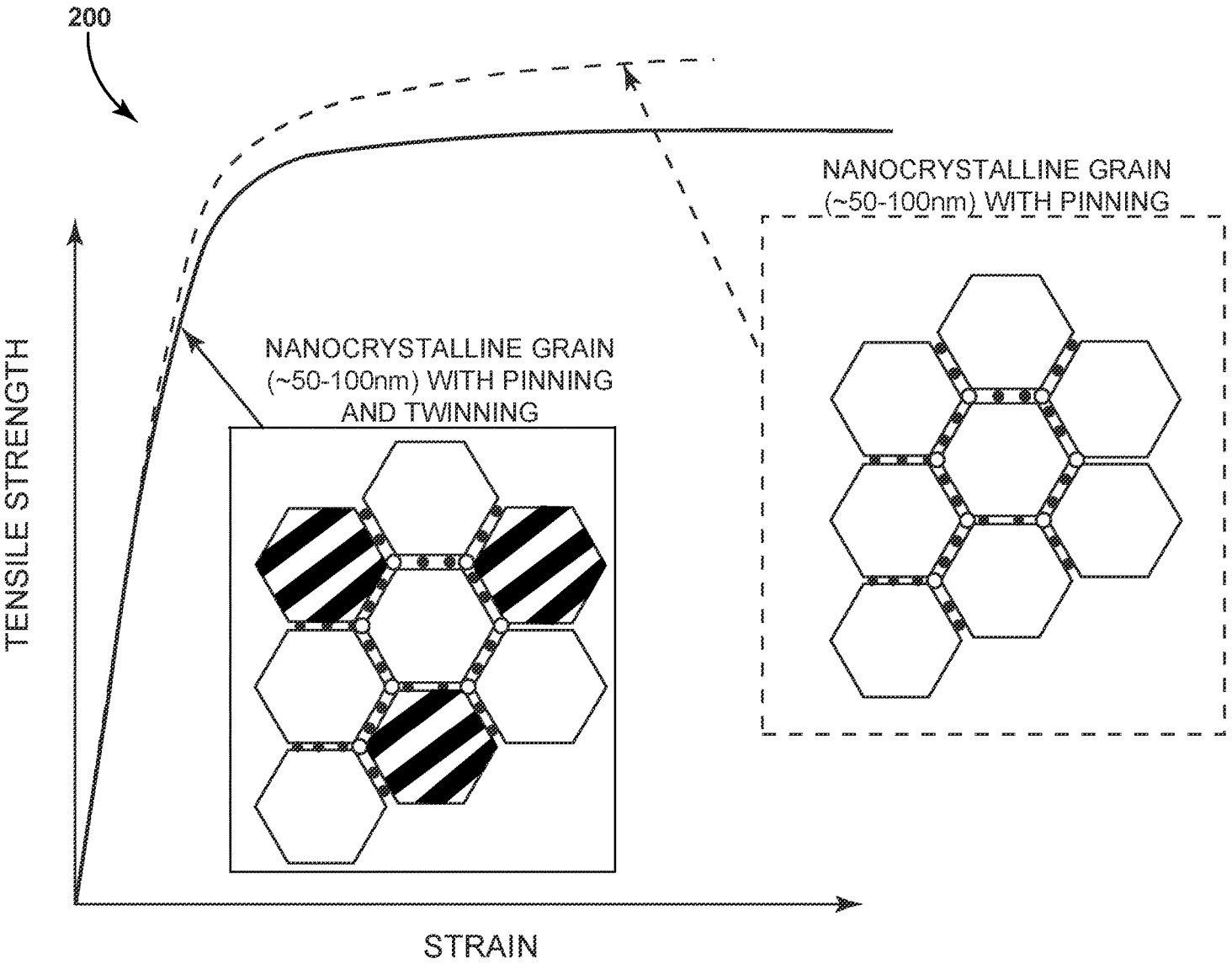
FIG. 7 is an exemplary stress-strain curve diagram generally comparing an ultra-fine twinned nanocrystalline nickel-cobalt grain to a nanocrystalline grain in the nickel-cobalt material of FIG. 2.

Turning to FIG. 7, a plot 200 illustrates exemplary stress-strain curves which illustrate effects of intragranular twinning. A nanocrystalline grain structure with both pinning and intragranular twinning can exhibit improved strength or ductility as compared to a nanocrystalline grain structure with pinning alone. The intragranular twins provide additional interfacial obstacles in the form of coherent twin boundaries which contribute to tensile strength in a similar manner as reduced grain size, yet these coherent twin boundaries provide slip planes that can contribute to ductility. The slip plane at intragranular twin boundaries can contribute to increased ductility in varying degrees depending on local geometric configurations and stresses.

Figure 8:
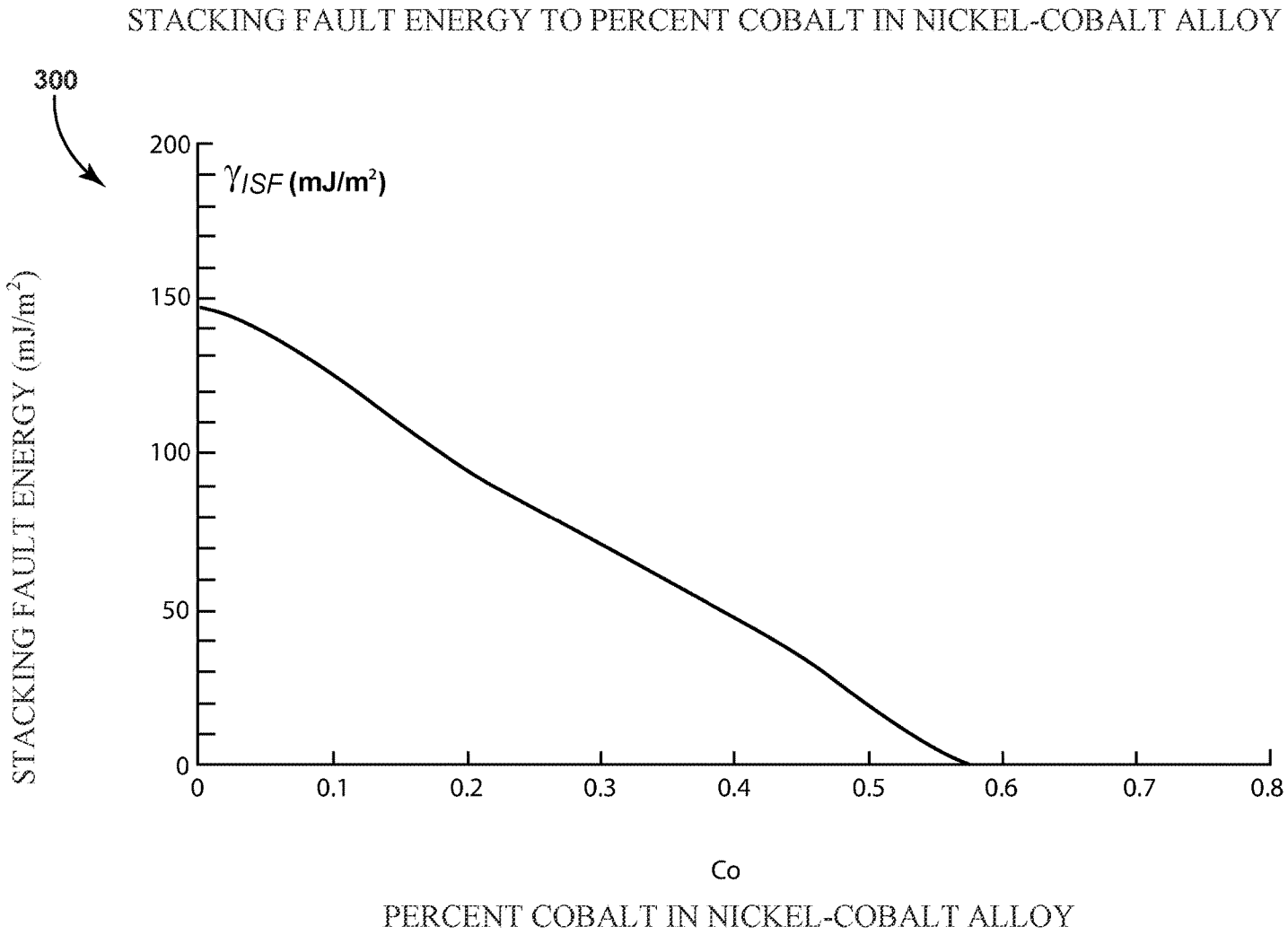
FIG. 8 is a plot diagram correlating stacking fault energy to percent cobalt in the nickel-cobalt material of FIG. 2.

FIG. 8 shows a plot 300 illustrating the stacking fault energy of nickel-cobalt alloys as a function of cobalt content. As shown, the stacking fault energy of the nickel-cobalt alloy decreases as the percentage of cobalt in the alloy increases. For example, a nickel-cobalt alloy with about 10% cobalt can have a stacking fault energy of about 125 $mJ/m^2$, whereas the alloy can have a stacking fault energy of about 75 $mJ/m^2$ with about 30% cobalt, or about 40 $mJ/m^2$ with about 40% cobalt. Nickel-cobalt alloys such as the nickel-cobalt material 100 can have a greater proclivity to produce twins compared to unalloyed Ni due to a decrease in stacking fault energy (SFE). Increases in percent Co in the nickel-cobalt material 100, including up to a concentration of about 50%, can further decrease the stacking fault energy as shown in FIG. 8. Controlling and tuning the concentration of cobalt can also be used to improve ductility as well as thermal and distortion strengthening. For example, the stacking fault energy for 100% Ni is about 125 $mJ/m^2$. It is reduced for NiCo with 30% Co to about 75 $mJ/m^2$ and can be further reduced to about 40 $mJ/m^2$ with 40% Co.

Figure 9:
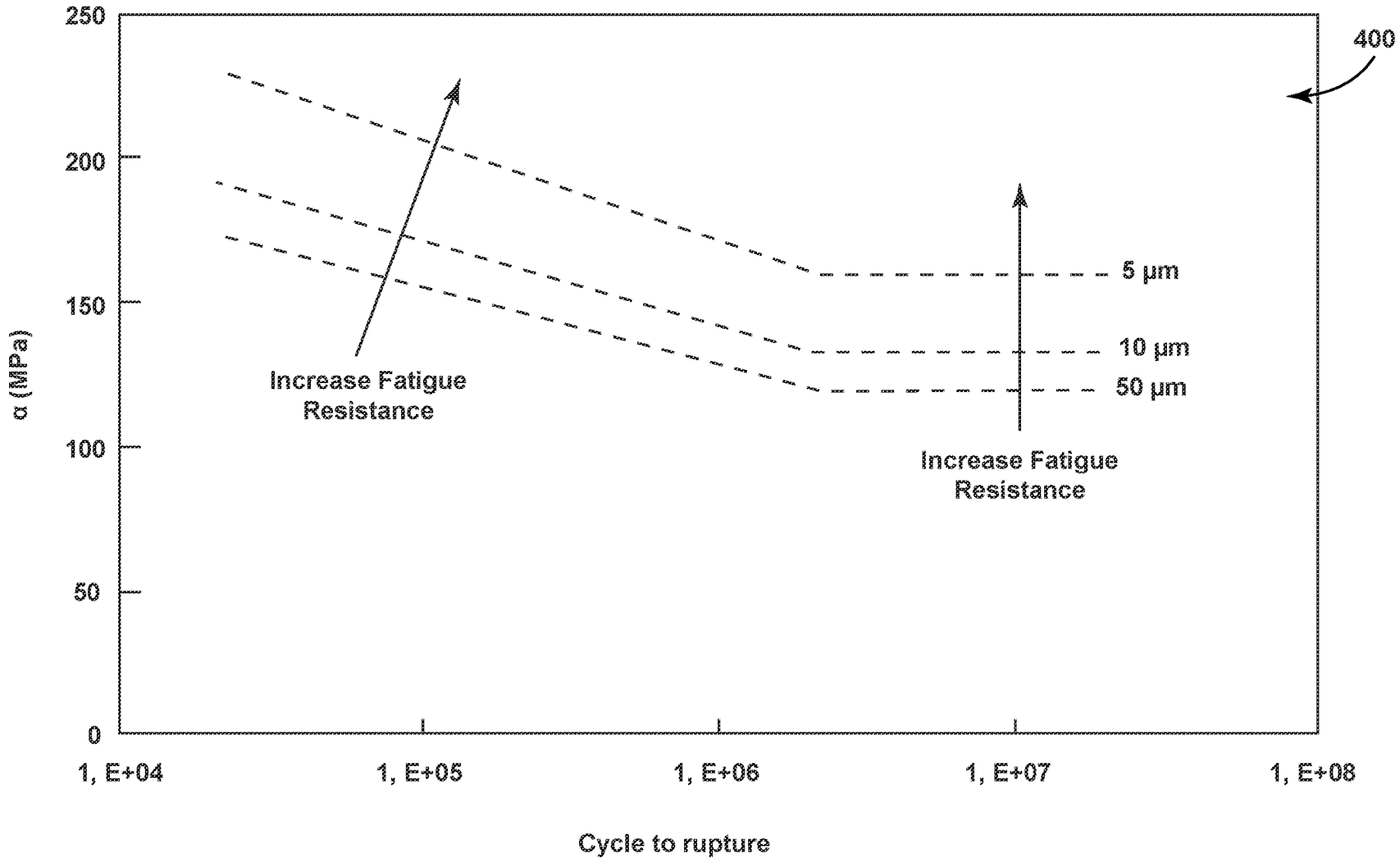
FIG. 9 is a plot diagram illustrating fatigue resistance as a function of grain size for an exemplary metal in the form of stainless steel.

FIG. 9 illustrates a plot 400 relating fatigue resistance as a function of grain size for an exemplary metal, more specifically stainless steel such as SS304. The illustrated grain sizes are 47 μm (plotted with circles), 17 μm (plotted with triangles), and 3 μm (plotted with squares). For example, the stainless steel can be placed under a cyclic load and fatigue resistance can be measured by a number of cycles until the material is fatigued, e.g. by fracturing, under a range of applied stresses. All grain sizes shown demonstrate a larger fatigue resistance with lower applied stress. In addition, all grain sizes have an "infinite life strength" wherein the number of cycles to fracture is extremely large, or "infinite," at or below a certain applied stress. For example, if the material in question is utilized for a component experiencing applied stresses at or below the "infinite life strength" of the material, such a component will not be expected to experience fatigue during operation (e.g. crack propagation) over the lifetime of the component. Overall fatigue crack resistance is increased with reduced grain size, as can be seen in the plot 400. Grain size, number of twins, and twin thickness or width can affect the propagation of a crack and the magnitude of the material's infinite-life strength.

Figure 10:
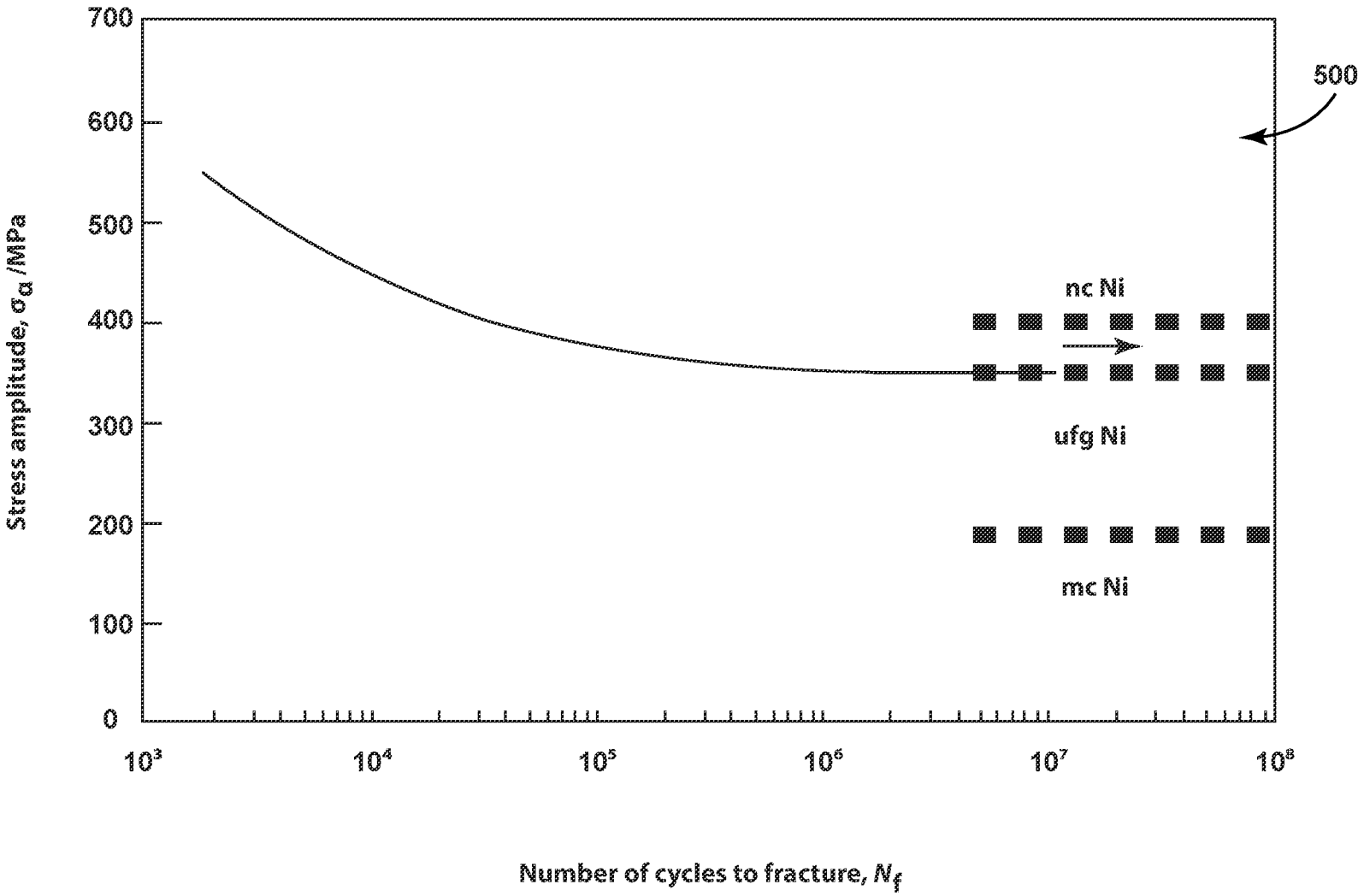
FIG. 10 is a plot diagram illustrating fatigue resistance as a function of grain size for another exemplary metal in the form of electrodeposited nickel.

FIG. 10 illustrates a plot 500 relating fatigue resistance as a function of grain size for another exemplary metal in the form of electrodeposited nickel. The illustrated grain sizes are nanocrystalline nickel, ultra-fine-grain nickel, and microcrystalline nickel. Similar to that shown in FIG. 9, overall fatigue crack resistance increases with reduced grain size.

With reference to FIGS. 9 and 10, it can be appreciated that aspects of the nickel-cobalt material 100 as described herein provide for increased fatigue resistance at smaller grain sizes. For example, the nickel-cobalt material 100 can have a grain size of less than 100 nm, including approximately 85 nm. A direct relationship has been determined between grain and twin size or width and crack initiation and fatigue failure stress. In such a case, crack initiation occurred at greater stresses with nano-grained materials as compared to larger grain sizes. The nanocrystalline nickel-cobalt material 100 can also demonstrates a high fatigue failure strength or material fracture toughness. In one example, the nickel-cobalt material can exhibit a fracture toughness of about 10 $MPa \cdot m^{1/2}$ to 70 $MPa \cdot m^{1/2}$. In another example, the nickel-cobalt material 100 can exhibit a Vickers hardness greater than 400 Hv.

A method of forming a material such as the nickel-cobalt material 100 includes forming a doped nickel-cobalt precursor material 100 via an electrodeposition process and heat treating the doped nickel-cobalt precursor material 100, wherein the heat treating includes at least heating at a temperature below the onset temperature for grain growth in the doped nickel-cobalt precursor material 100 to form a heat treated nickel-cobalt material 100. The doped nickel-cobalt precursor material 100 can include at least one of a phosphorous-doped nickel-cobalt material or a boron-doped nickel-cobalt material as described above. Optionally, an example utilizing a phosphorous-doped nickel-cobalt material can comprise from about 30% to about 35% by atomic weight of cobalt, from about 1,000 ppm to about 1,500 ppm by atomic weight of phosphorous, and nickel as the balance of the material.

The heat treating can form at least one of phosphorous precipitates at nanocrystalline grain boundaries or intragranular twinning as described above. The phosphorous-doped nickel-cobalt material can include a nanocrystalline grain structure having a grain size distribution of about 50 to 100 nanometers. The phosphorous-doped nickel-cobalt material can exhibit a fracture toughness of about 10 $MPa \cdot m^{1/2}$ to 70 $MPa \cdot m^{1/2}$, an ultimate tensile strength of from about 1000 MPa to about 1500 MPa, and have an increased thermal stability with an onset temperature of about 50% or 60% of the melting temperature for the alloy as described above. In addition, the method can also include processing the heat treated nickel-cobalt material into an aircraft component as described above.

Aspects of the disclosed nickel-cobalt material as described herein provide for a variety of benefits, including improved fatigue resistance and material hardness. Aspects of the disclosure provide for a nanocrystalline nickel-based novel electrodeposited alloy with excellent thermal stability, high-strength low cycle fatigue, and crack-resistant high cycle fatigue material performance. This results in efficient use of material via the electrodeposition process for a wide range of components, including turbine engine components which are placed under a variety of stresses and fatigue conditions.

To the extent not already described, the different features and structures of the various embodiments may be used in combination with each other as desired. That one feature may not be illustrated in all of the embodiments and is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A nickel-cobalt material, comprising:

a nanocrystalline grain structure with a grain size distribution of about 50 nanometers to about 110 nanometers, the nanocrystalline grain structure comprising phosphorous precipitates at nanocrystalline grain boundaries and intragranular twinning, the material having a chemical makeup comprising from about 25% to about 40% by atomic weight cobalt, from about 1,000 ppm to about 3,500 ppm by atomic weight of phosphorous or boron, and nickel.

2. The nickel-cobalt material of claim 1 wherein nickel forms the balance of the material.

3. The nickel-cobalt material of claim 1 wherein fatigue crack resistance in the nickel-cobalt material is increased with reduced nanocrystalline grain size.

4. The nickel-cobalt material of claim 1, wherein the nickel-cobalt material exhibits a Vickers hardness greater than 400 Hv.

5. The nickel-cobalt material of claim 1 wherein the nickel-cobalt material exhibits a fracture toughness of about 10 $MPa \cdot m^{1/2}$ to 70 $MPa \cdot m^{1/2}$.

6. The nickel-cobalt material of claim 1 wherein the nickel-cobalt material exhibits an increased thermal stability with an onset temperature of about 50% or 60% of the melting temperature for the material.

7. The nickel-cobalt material of claim 1 wherein the nickel-cobalt material exhibits an ultimate tensile strength of from about 1,000 MPa to about 1,500 MPa.

8. A component, comprising:

a body wherein at least a portion thereof includes a thermally stabilized nickel-cobalt alloy with nanocrystalline grain structures, pinning and intragranular twinning that exhibits fracture toughness of about 10 $MPa \cdot m^{1/2}$ to 70 $MPa \cdot m^{1/2}$, an increased thermal stability with an onset temperature of about 50% or 60% of the melting temperature for the alloy, and an ultimate tensile strength of from about 1,000 MPa to about 1,500 MPa, wherein the nickel-cobalt alloy includes a chemical makeup comprising from about 30% to about 35% by atomic weight cobalt, from about 1,000 ppm to about 1,500 ppm by atomic weight of phosphorous or boron, and nickel as the balance of the material.

9. A component, comprising:

a body wherein at least a portion thereof includes a thermally stabilized nickel-cobalt alloy with nanocrystalline grain structures, pinning and intragranular twinning that exhibits fracture toughness of about 10 $MPa \cdot m^{1/2}$ to 70 $MPa \cdot m^{1/2}$, an increased thermal stability with an onset temperature of about 50% or 60% of the melting temperature for the alloy, and an ultimate tensile strength of from about 1,000 MPa to about 1,500 MPa, wherein the pinning comprises phosphorous precipitates at boundaries between the nanocrystalline grain structures.

10. The component of claim 9 wherein the nanocrystalline grain structures include a grain size distribution of about 50 nanometers to about 110 nanometers.

* * * * *